US006513497B1

(12) United States Patent
Mahr et al.

(10) Patent No.: US 6,513,497 B1
(45) Date of Patent: Feb. 4, 2003

(54) FUEL INJECTION SYSTEM FOR INTERNAL COMBUSTION ENGINES

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,917

(22) PCT Filed: Aug. 2, 2000

(86) PCT No.: PCT/DE00/02579

§ 371 (c)(1),
(2), (4) Date: May 21, 2001

(87) PCT Pub. No.: WO01/14724

PCT Pub. Date: Mar. 1, 2001

(30) Foreign Application Priority Data

Aug. 20, 1999 (DE) ..... 199 39 429

(51) Int. Cl.[7] ..... F02M 57/02; F02M 59/10

(52) U.S. Cl. ..... 123/447; 123/446; 123/467

(58) Field of Search ..... 123/446, 447, 123/456, 467

(56) References Cited

U.S. PATENT DOCUMENTS

| | | | | |
|---|---|---|---|---|
| 4,142,497 A | * | 3/1979 | Long | 123/456 |
| 4,674,448 A | * | 6/1987 | Steiger | 123/447 X |
| 5,355,856 A | * | 10/1994 | Paul et al. | 123/446 |
| 5,622,152 A | * | 4/1997 | Ishida | 123/446 |
| 6,076,504 A | * | 6/2000 | Stavnheim et al. | 123/447 |

* cited by examiner

*Primary Examiner*—Tony M. Argenbright
(74) *Attorney, Agent, or Firm*—Ronald E. Greigg

(57) ABSTRACT

A fuel injection system has one or more unit fuel injectors or pump-line-nozzle system, corresponding in number to the number of cylinders, for compressing the fuel and a hydraulic pressure booster unit. With the aid of the unit fuel injector and the pressure booster unit, a fuel injection can be performed with great precision over a wide rpm range.

4 Claims, 8 Drawing Sheets

FUEL INJECTION SYSTEM FOR INTERNAL COMBUSTION ENGINES

CROSS REFERENCE TO RELATED APPLICATIONS

This application is a 35 USC 371 application of PCT/DE 00/02579 filed on Aug. 2, 2000.

BACKGROUND OF THE INVENTION

1. Field of the Invention

The invention relates to a fuel injection system for an internal combustion engine, and more particularly to such a system including a pressure booster.

2. Brief Description of the Prior Art

For better comprehension of the specification and claims, several terms will now be explained: The fuel injection system of the invention can be embodied as either stroke-controlled or pressure-controlled. As used herein, the term, "stroke-controlled fuel injection system" is understood to mean that the opening and closing of the injection opening is effected with the aid of a displaceable valve member on the basis of the hydraulic cooperation of the fuel pressures in a nozzle chamber and in a control chamber. A pressure drop inside the control chamber causes a stroke of the valve member. Alternatively, the deflection of the valve member can be done by a final control element (actuator). In a "pressure-controlled fuel injection system" according to the invention, the valve member is moved counter to the action of a closing force (spring) by the fuel pressure prevailing in the nozzle chamber of an injector, so that the injection opening is uncovered for an injection of the fuel out of the nozzle chamber into the cylinder. The pressure at which fuel emerges from the nozzle chamber into a cylinder is called the "injection pressure", while the term "system pressure" is understood to mean the pressure at which the fuel is available or kept on hand inside the fuel injection system. "Fuel metering" means delivering fuel to the nozzle chamber by means of a metering valve. In "combined fuel" metering, a common valve is used to measure various injection pressures. In the "unit fuel injector" (PDE), the injection pump and the injector form a unit. One such unit per cylinder is built into the cylinder head and driven by the engine camshaft, either directly via a tappet or indirectly via tilting levers. The "pump-line-nozzle system" (PLD) operates by the same method. A high-pressure line in that case leads to the nozzle chamber or nozzle holder.

A unit fuel injector is known from German Patent Disclosure DE 195 175 78 A1. In this fuel injection system, the system pressure is generated via a pressure-actuatable piston, whose motion is controlled by a cam drive. A variable fuel injection of different quantities for the pre-injection, main injection and post-injection can be accomplished only to a limited extent with such a fuel injection system.

SUMMARY OF THE INVENTION

The fuel injection system of the present invention makes it possible to achieve the fuel injection with the aid of a unit fuel injector over a wide rpm range with high precision. This makes it possible to remove pollutant exchange and enables more flexible pre-injection and post-injection by means of a unit fuel injector or a pump-line-nozzle system. The teaching according to the invention combines the advantages of a pressure-boosted (pressure-amplified) injector with a non-pressure-boosted unit fuel injector. If a piezoelectric actuator is used for fuel metering, improved metering of the injected fuel quantity can be attained. This creates a good minimum quantity capability in the pre-injection and if needed in the post-injection, because such an injection is done under stroke control with a lesser injection pressure. The pre-injection and post-injection are done flexibly and replicably. Good hydraulic efficiency of the pressure boosting is achieved if the pressure booster is disposed inside the injector. The course of injection can be varied in a targeted way.

BRIEF DESCRIPTION OF THE DRAWINGS

Other features and advantages of the invention will be apparent from the detailed description contained herein below, taken with the drawings, in which.

DESCRIPTION OF THE PREFERRED EMBODIMENTS

Figure 1:
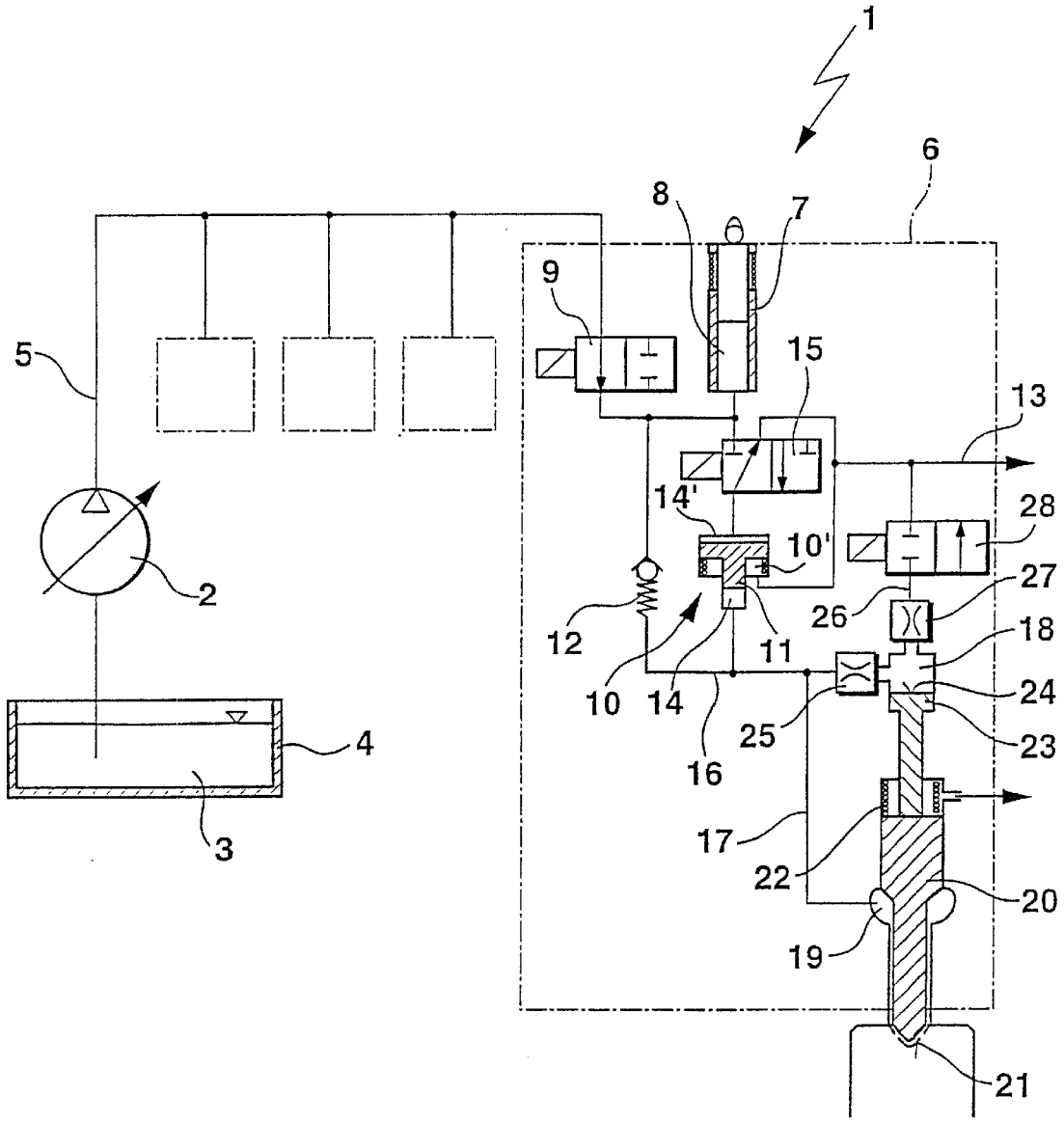
FIG. 1, schematically illustrates a first stroke-controlled fuel injection system, with a unit fuel injector and a pressure booster unit.

In the first exemplary embodiment, shown in FIG. 1, of a stroke-controlled fuel injection system 1, a fuel feed pump 2 pumps fuel 3 out of a tank 4 via a supply line 5 to a plurality of unit fuel injectors 6 (injection devices), corresponding in number to the number of individual cylinders of, and protruding into the combustion chambers of the internal combustion engine to be supplied. In FIG. 1, only one of the unit fuel injectors 6 is shown.

Each unit fuel injector 6 is composed of a fuel compression device 7 and means for injection. Per engine cylinder, one unit fuel injector 6 is built into a cylinder head. The fuel compression device 7 is driven by an engine camshaft, either directly via a tappet or indirectly via tilting levers. Electronic regulating devices make it possible to exert targeted influence on the quantity of injected fuel (course of injection).

The fuel compression device 7 can compress fuel in a compression chamber 8. The fuel metering is done via a 2/2-way valve 28. By means of a cross-sectional control of the valve 9 that initiates the pressure buildup, or of the valve 28, a variable injection pressure can be achieved by means of throttling. The fuel compression device 7 can be part of a unit fuel injector (PDE) known per se or of a pump-line-nozzle system (PLD). The fuel compression device 7 serves to generate a first, lower system pressure. A hydraulic pressure booster unit 10 that can be added can be circumvented, via a bypass that contains the check valve 12, if fuel is to be injected at a first system pressure.

For injecting fuel at a second, higher system pressure, the pressure booster unit 10 includes a valve unit for triggering the pressure boost (3/2-way valve) 15, a check valve 12, and a pressure medium 11 in the form of a displaceable piston element. The pressure medium 11 can be connected on one end, with the aid of the valve unit 15, to a fuel pressure line, so that the pressure medium 11 can be acted upon by pressure on one end. A differential chamber 10' is pressure-relieved by means of a leakage line 13, so that the pressure medium 11 can be displaced in order to reduce the volume of a pressure chamber 14. The pressure medium 11 is moved in the compression direction, so that the fuel located in the pressure chamber 14 is compressed and delivered to a control chamber 18 and a nozzle chamber 19. The check valve 12 prevents the return flow of compressed fuel. By means of a suitable ratio of surface area in a primary chamber 14' and the pressure chamber 14, a second, higher pressure can be generated. If the primary chamber 14' is connected to the leakage line 13 with the aid of the valve unit 15, then the restoration of the pressure medium 11 and the refilling of the pressure chamber 14 take place. Because of the pressure conditions in the pressure chamber 14 and the primary chamber 14', the check valve 12 opens, so that during the piston stroke of the fuel compression device 7, pressure is exerted on the pressure chamber 14, and the pressure medium 11 is hydraulically restored to its outset position. To improve the restoration, one or more springs can be disposed in the chambers 10', 14 and 14'. By means of the pressure boost, a second system pressure can thus be generated. Pressure lines 16 and 17 therefore deliver fuel at the first or second system pressure to the control chamber 18 and the nozzle chamber 19.

The injection is effected via a fuel metering, with aid of a pistonlike valve member 20, which is axially displaceable in a guide bore, with a conical valve sealing face 21 on one end, with which it cooperates with a valve seat face on the injector housing of the injector unit 6. Injection openings (not shown) are provided on the valve seat face of the injector housing. Inside the nozzle chamber 19, a pressure face pointing in the opening direction of the valve member 20 is exposed to the pressure prevailing there, which is delivered to the nozzle chamber 19 via the pressure line 17. Coaxially with a compression spring 22, a tappet 23 also engages the valve member 20; with its face end 24 remote from the valve sealing face 21, this tappet defines the control chamber 18. The control chamber 18 has an inlet, from the fuel pressure connection, with a first throttle 25 and an outlet to a pressure relief line 26, with a second throttle 27 that is controlled by the 2/2-way valve 28.

The nozzle chamber 19 is continued across an annular gap between the valve member 20 and the guide bore, as far as the valve seat face of the injector housing. The tappet 23 is subjected to pressure in the closing direction via the pressure in the control chamber 18.

The 2/2-way valves and 3/2-way valves are actuated by electromagnets for opening or closing or for switchover. The electromagnets are triggered by a control unit, which is capable of monitoring and processing various operating parameters (engine rpm, and so forth) of the engine to be supplied.

Instead of the magnet-controlled valve units, piezoelectric final control elements (actuators), which have a requisite temperature compensation and optionally a requisite force or travel boost, can also be employed.

Fuel at the first or second system pressure fills the nozzle chamber 19 and the control chamber 18. Upon actuation of the 2/2-way valve 28 (opening), the pressure in the control chamber 18 can be reduced, so that as a consequence, the pressure in the nozzle chamber 19 exerted in the opening direction on the valve member 20 exceeds the pressure acting on the valve member 20 in the closing direction. The valve sealing face 21 lifts away from the valve seat face, and fuel is injected. The process of pressure relief of the control chamber 18 and thus the stroke control of the valve member 20 can be varied by way of the dimensioning of the throttle 25 and the throttle 27.

The end of injection is initiated by re-actuation of the 2/2-way valve 28, which disconnects the control chamber 18 from the leakage line 13 again, so that once again, a pressure capable of moving the tappet 23 in the closing direction builds up in the control chamber 18.

Figure 2:
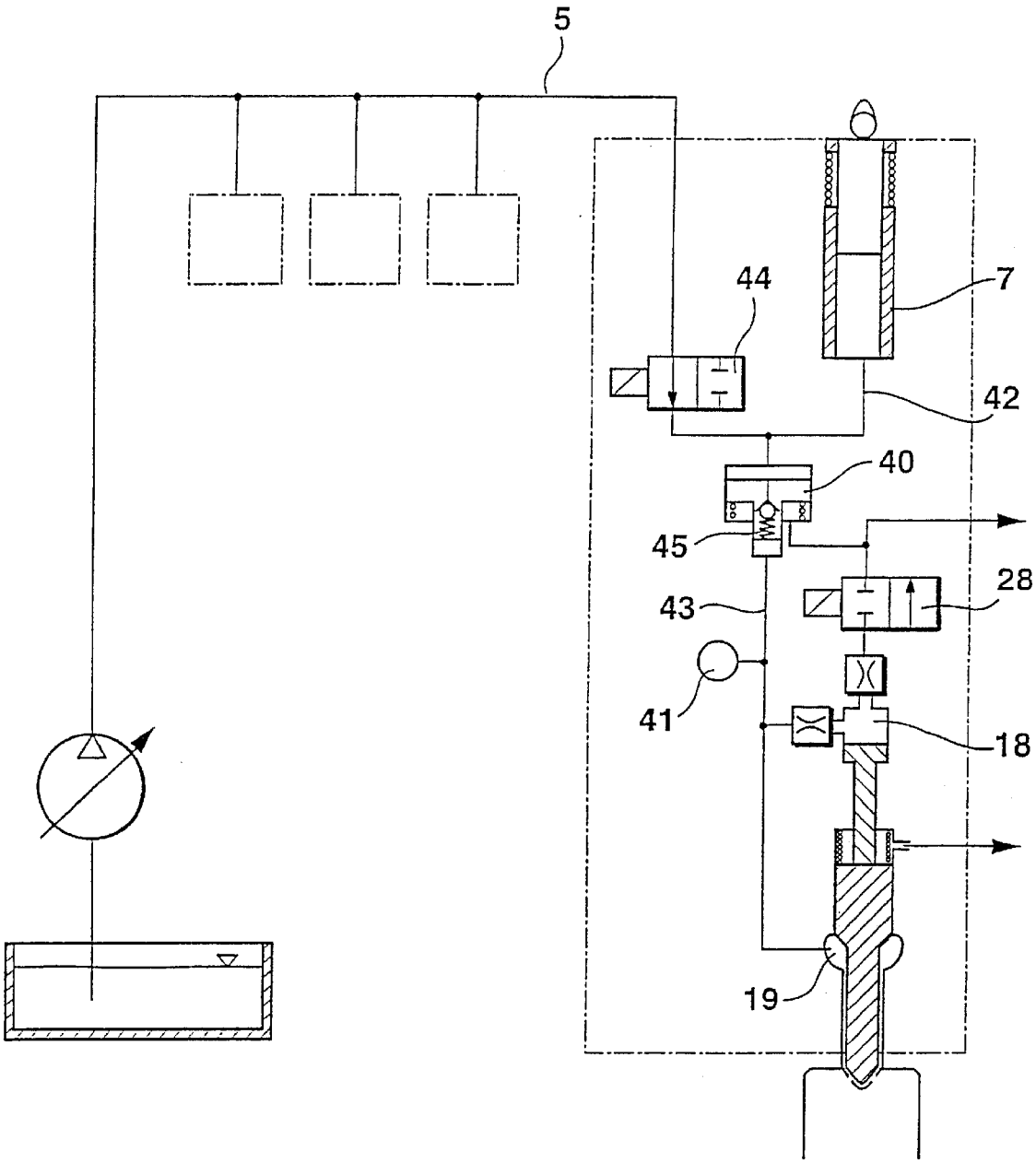
FIG. 2, schematically illustrates a second stroke-controlled fuel injection system with a unit fuel injector, a pressure booster unit, and a pressure storage chamber.

It can be seen from FIG. 2 that a pressure storage chamber 41 is connected between a pressure booster unit 40 and the control chamber 18 or nozzle chamber 19. The pressure buildup is effected by way of actuation (closure) of the 2/2-way way valve 44. By means of a cross-sectional control of the valve 28 or the valve 44, a variable injection pressure and thus a shaping of the course of injection can be achieved by means of throttling. As the final control element (actuator), a suitable magnet valve or a piezoelectric actuator with a settable stroke can be used. Such a piezoelectric actuator can be embodied with temperature compensation and if needed with a hydraulic force or travel boost.

The first system pressure can be generated by means of the fuel compression device 7 and delivered over pressure lines 42 and 43 to the control chamber 18 or the nozzle chamber 19.

With the aid of the pressure booster unit 40, a high system pressure is made possible; a check valve 45 then separates the low-pressure part from the high-pressure part. The refilling is done with the pressure buildup valve 44 opened.

Figure 3:
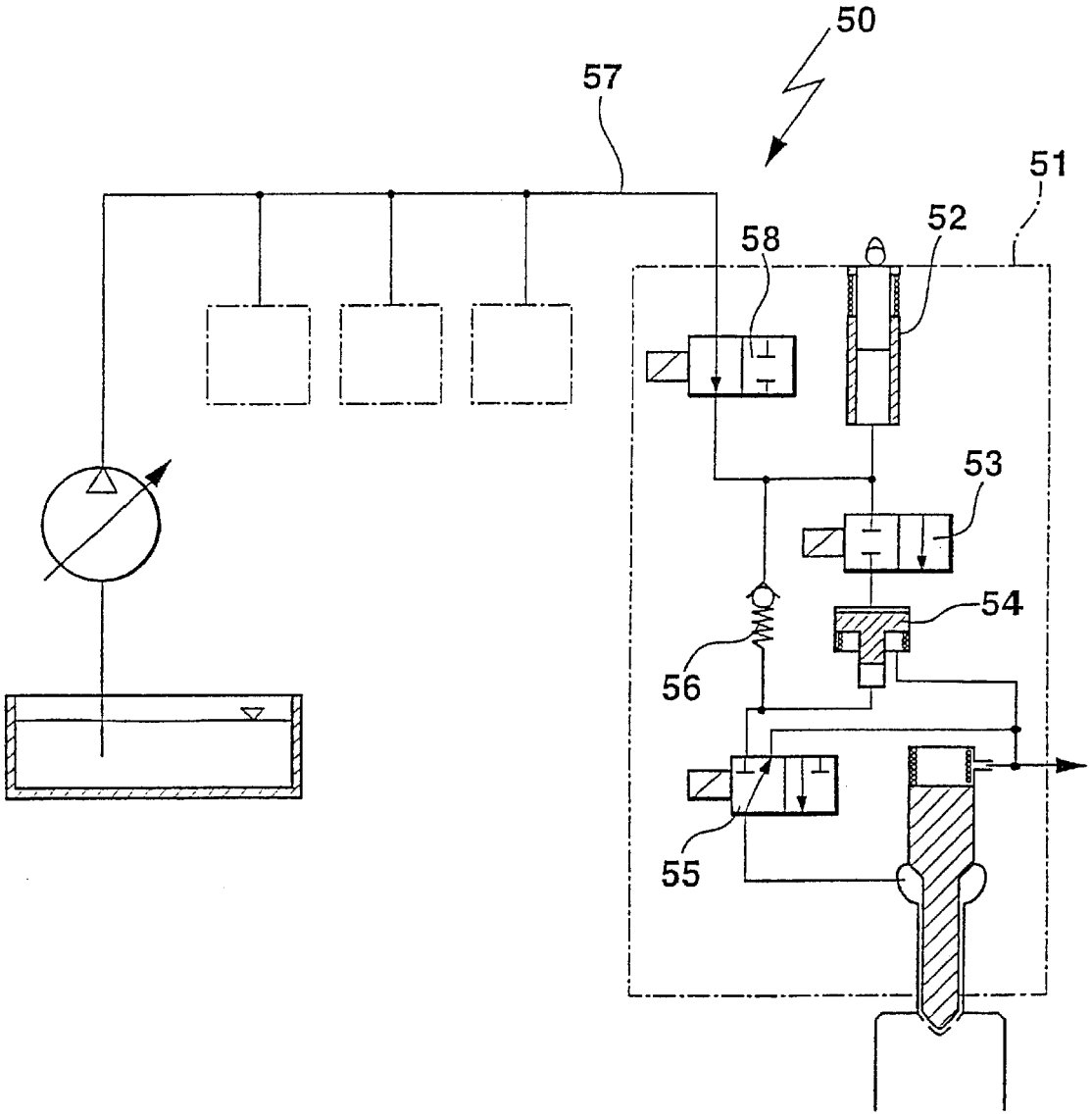
FIG. 3, schematically illustrates a first pressure-controlled fuel injection system with a unit fuel injector and a pressure booster unit.

Fuel injection system 50 as shown in FIG. 3 also has a unit fuel injector 51. The primary system pressure generation is done via the fuel compression device 52 and is activated via the closure of a 2/2-way valve 58. Depending on the triggering of the 2/2-way valve 58, the beginning of the pressure buildup and thus the injection pressure can be varied. For the second, higher system pressure, a pressure booster unit 54 is activated with the aid of the 2/2-way valve 53. The bypass around the pressure booster unit is then deactivated via the check valve 56. The control of the injection is done under pressure control by means of a 3/2-way valve 55. The lower system pressure can be used for a pre-injection and as needed for a post-injection as well as for forming a boot injection. The refilling of the pressure booster unit takes place with the valves 58 and 53 open.

Figure 4:
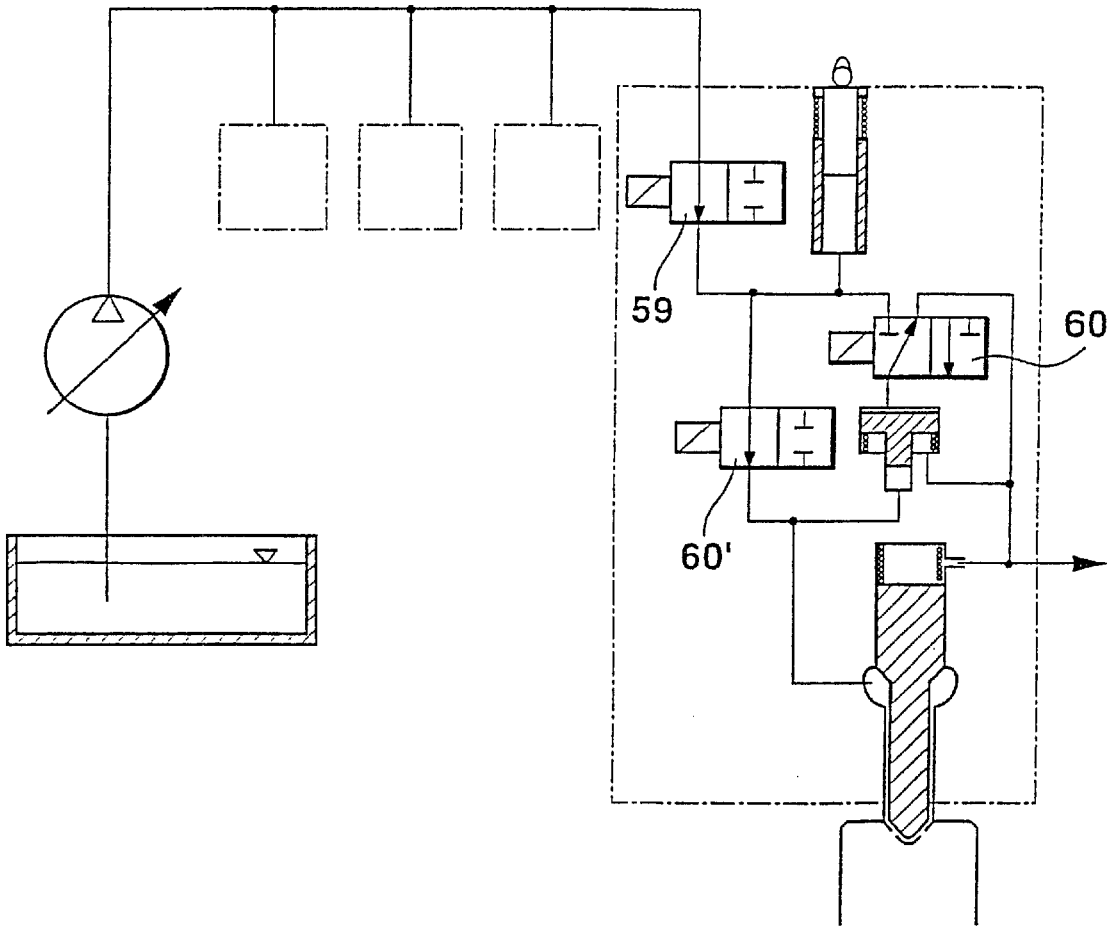
FIG. 4, schematically illustrates a second pressure-controlled fuel injection system with a unit fuel injector and a pressure booster unit.

By means of the disposition, shown in FIG. 4, of the 2/2-way valves 59, 60' and a 3/2-way valve 60, a separate metering of fuel, instead of combined metering, at the two pressure levels can be done.

Figure 5:
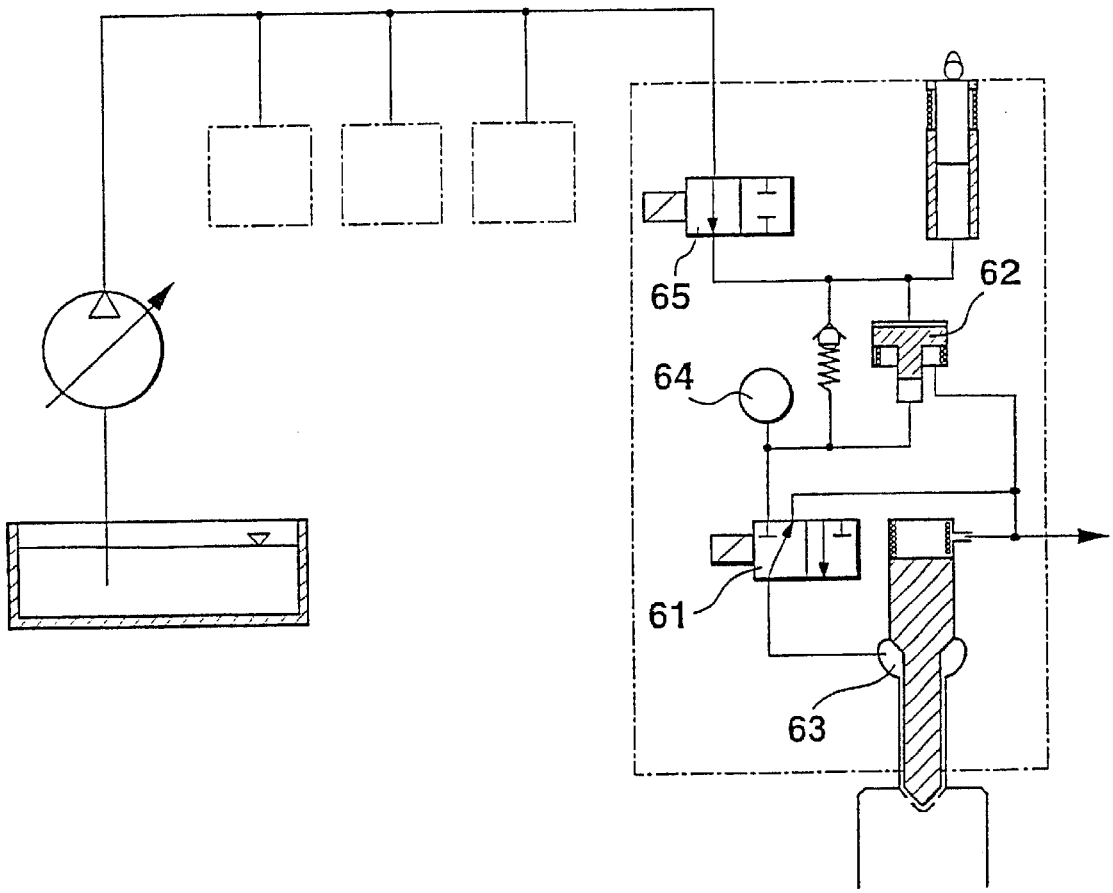
FIG. 5, schematically illustrates a third pressure-controlled fuel injection system with a unit fuel injector and a pressure booster unit.
Figure 6:
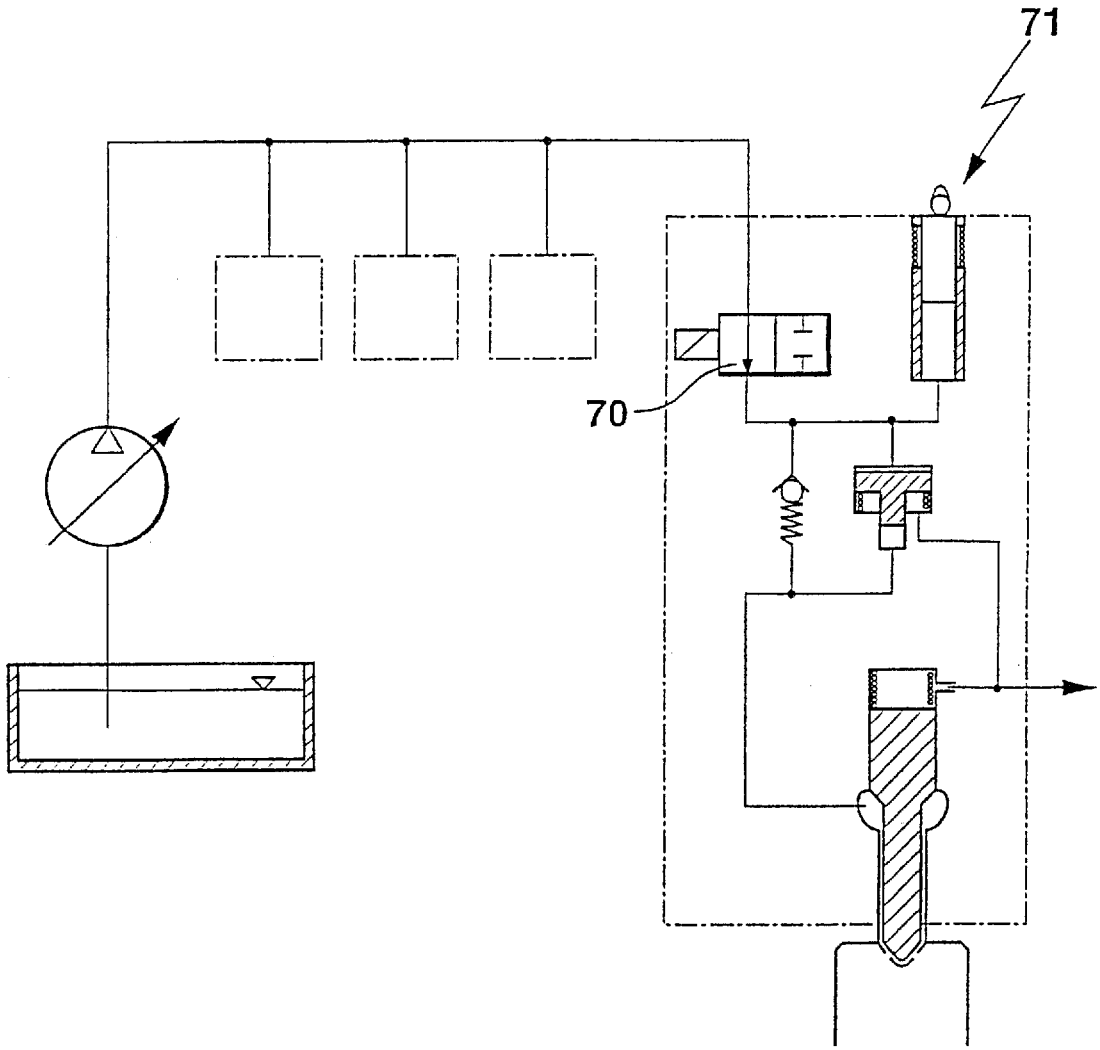
FIG. 6, schematically illustrates a fourth pressure-controlled fuel injection system with a unit fuel injector and a pressure booster unit.

In a fuel injection system 60 of FIG. 5, the metering is done via a 3/2-way valve 61 with a piezoelectric final control element (piezoelectric actuator). This makes improved metering of fuel possible. In addition, a pressure limiting valve should be disposed upstream or downstream of the pressure booster unit 62, to prevent destruction in the event of failure of the piezoelectric final control element. A pressure storage chamber 64 is disposed locally between the pressure booster unit 62 and the nozzle chamber 63, but it can also be disposed upstream of the pressure booster unit 62, as a result of which greater flexibility in terms of the injection window can be achieved. By means of a cross-sectional control of the valve 61 or the valve 65, a variable injection pressure and thus a shaping of the course of the injection can be achieved by means of throttling. As the final control element (actuator), a suitable magnet valve or a piezoelectric actuator with an adjustable stroke can be used. A piezoelectric actuator of this kind can be embodied with a temperature compensation and as needed with a hydraulic force and travel boost If a 2/2-way valve 70 with a piezoelectric final control element is used for the pressure buildup, as in the case of the fuel injection system 71 of FIG. 6, then it is possible to achieve shaping of the course of the injection by means of a defined stroke of the piezoelectric final control element.

Figure 7:
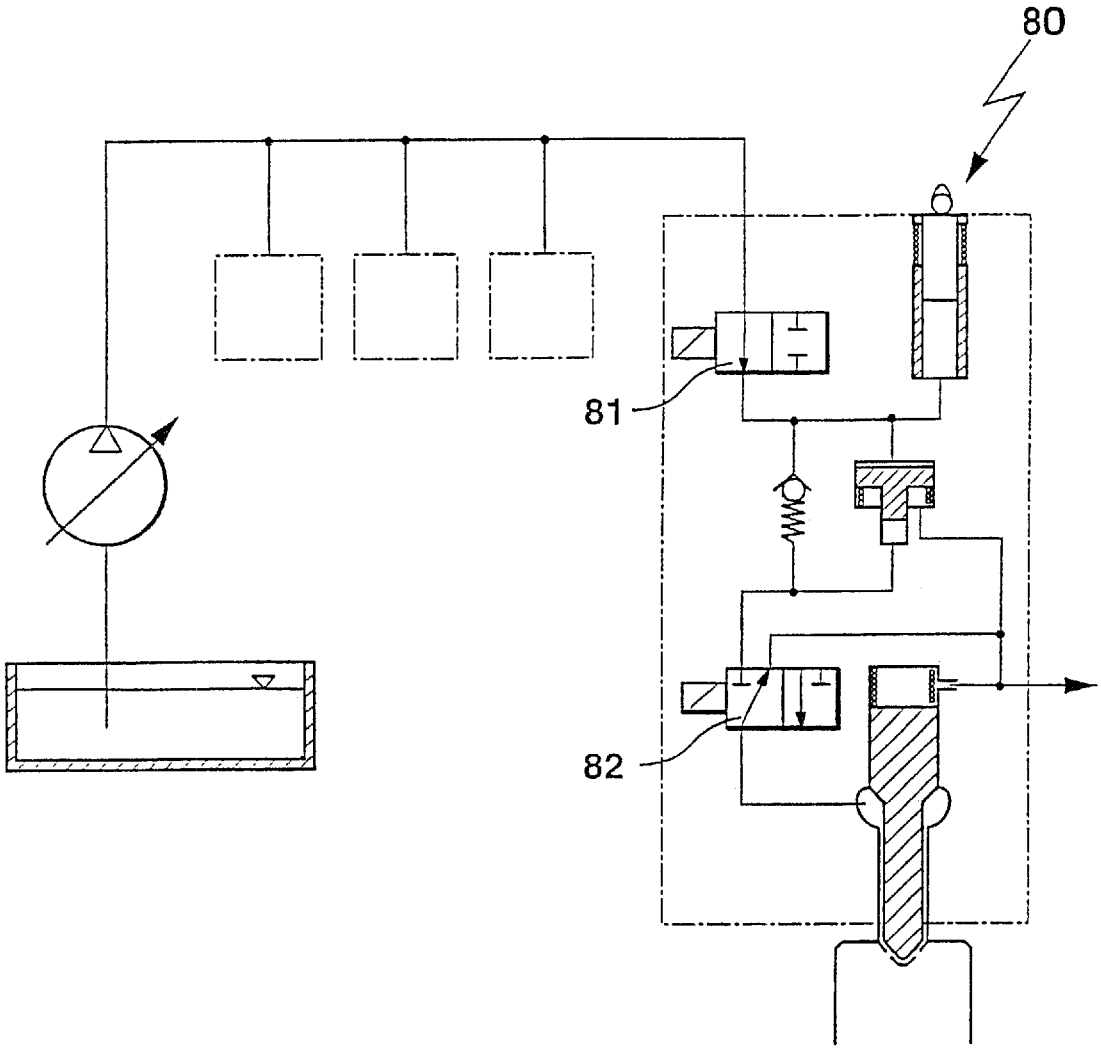
FIG. 7, schematically illustrates a fifth pressure-controlled fuel injection system with a unit fuel injector and a pressure booster unit.

The fuel injection system 80 of FIG. 7 has a 2/2-way valve 81 for controlling the pressure buildup and a 3/2-way valve 82 for controlling the injection. By means of a cross-sectional control of one of the two valves 81, 82, for instance by the use of a piezoelectric actuator, a variable injection pressure and thus a shaping of the course of the injection are possible.

Figure 8:
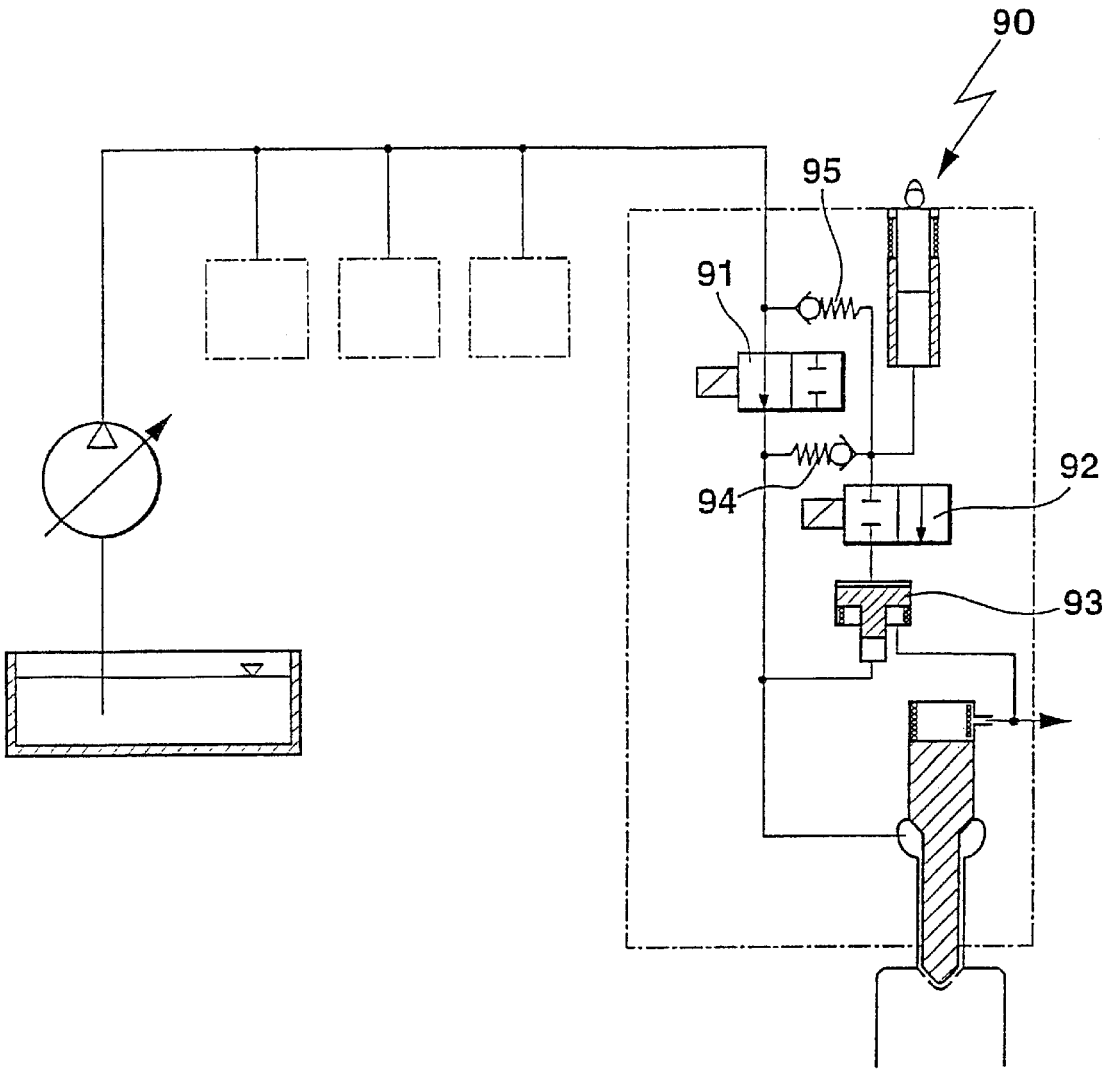
FIG. 8, schematically illustrates a sixth pressure-controlled fuel injection system with a unit fuel injector and a pressure booster unit.

The pressure buildup inside a fuel injection system 90 (FIG. 8) is controlled in turn by a 2/2-way valve 91. Via a pressure booster unit 93 activatable by a 2/2-way valve, a second, higher injection pressure can be generated. This pressure booster unit can be circumvented by a bypass, so that an injection can be done with non-pressure-boosted fuel. With the pressure booster unit 93 activated, the bypass line is disconnected from a check valve 94. The termination of injection or the refilling of the pressure booster unit 93 is done by opening of the valve 91, or the valves 91 and 92. With the aid of the check valve 95, it is possible to maintain a pressure level beyond the pumping stroke of the fuel pressure generation and thus to achieve more-flexible injection. For better storage of the pressure-impinged fuel, a pressure reservoir is also conceivable between the pressure buildup valve 91 and the nozzle chamber.

By lengthening or embodying a high-pressure line to the nozzle chamber, a pump-line-nozzle system can be realized in FIGS. 1–8. The control valves and the pressure booster unit can also be integrated in one unit or disposed at any arbitrary point between the injector and where the pressure is generated.

The foregoing relates to preferred exemplary embodiments of the invention, it being understood that other variants and embodiments thereof are possible within the spirit and scope of the invention, the latter being defined by the appended claims.

We claim:

1. In a fuel injection system (1; 50; 71; 80; 90) having one or more unit fuel injectors or pump-line-nozzle systems (6; 51), corresponding in number to the number of engine cylinders to be supplied, for compressing the fuel, the improvement wherein the fuel injection system (1; 50; 71; 80; 90) comprises a hydraulic pressure booster unit (10; 40; 54; 62; 93) having a displaceable piston element, wherein the fuel injection system includes a fuel supply line provided for bypassing the pressure booster unit (10; 40; 54; 62; 93), and wherein the fuel injection system is arranged so that the fuel supply line can bypass the pressure booster unit (10; 40; 54; 62; 93) regardless of the position of the displaceable piston element.

2. The fuel injection system of claim 1, wherein a cross-sectional control of at least one valve is provided for forming a course of injection.

3. The fuel injection system of claim 2, wherein a pressure storage chamber (41; 64) for storing fuel is disposed between the pressure booster unit (40; 62) and the nozzle chamber (19; 63).

4. The fuel injection system of claim 1, wherein a pressure storage chamber (41; 64) for storing fuel is disposed between the pressure booster unit (40; 62) and the nozzle chamber (19; 63).

* * * * *